US007954554B2

(12) United States Patent
Shampine et al.

(10) Patent No.: US 7,954,554 B2
(45) Date of Patent: Jun. 7, 2011

(54) COILED TUBING EQUIPMENT LIFTING METHODS

(75) Inventors: Rod Shampine, Houston, TX (US); Vishal Saheta, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 481 days.

(21) Appl. No.: 11/621,757

(22) Filed: Jan. 10, 2007

(65) Prior Publication Data

US 2007/0210199 A1 Sep. 13, 2007

Related U.S. Application Data

(60) Provisional application No. 60/781,027, filed on Mar. 10, 2006.

(51) Int. Cl.
*E21B 19/22* (2006.01)

(52) U.S. Cl. ..... 166/385; 166/77.2; 294/68.3

(58) Field of Classification Search ..... 166/77.1, 166/77.2, 385; 242/559, 598.5, 598.6, 614, 242/614.1; 294/81.5, 81.51, 68.3, 67.3; 414/911; 248/317, 322, 329, 332, 339, 340, 489, 492
See application file for complete search history.

(56) References Cited

U.S. PATENT DOCUMENTS

| | | | | |
|---|---|---|---|---|
| 3,343,861 | A | 9/1967 | Sinicki | |
| 3,549,190 | A * | 12/1970 | Caldwell | 294/81.2 |
| 4,884,454 | A | 12/1989 | Johnson | |
| 4,945,938 | A * | 8/1990 | Ponsford et al. | 137/15.01 |
| 5,445,426 | A * | 8/1995 | Sorensen | 294/67.3 |
| 5,561,931 | A | 10/1996 | Duenkel | |
| 5,836,536 | A * | 11/1998 | Bodden | 242/390.5 |
| 6,332,364 | B1 | 12/2001 | Buschmann | |
| 6,494,103 | B1 | 12/2002 | Loong | |
| 6,494,397 | B1 * | 12/2002 | Myklebust | 242/399.1 |
| 6,637,274 | B2 | 10/2003 | Metelski | |
| 6,672,529 | B2 * | 1/2004 | Cain et al. | 242/394 |
| 6,901,998 | B1 * | 6/2005 | Roodenburg et al. | 166/85.1 |
| 6,935,196 | B1 | 8/2005 | Tumlin | |
| 7,155,987 | B1 | 1/2007 | Tumlin | |

FOREIGN PATENT DOCUMENTS

| | | |
|---|---|---|
| DE | 9002873 | 12/1990 |
| JP | 09086790 | 3/1997 |
| WO | 0170597 | 9/2001 |

OTHER PUBLICATIONS

Rules for Certification of Lifting Appliances—Det norske Veritas Classification A/S, Veritasveien 1, 1322 Hovik, Norway Jul. 1989.

* cited by examiner

*Primary Examiner* — Shane Bomar
*Assistant Examiner* — Robert E Fuller
(74) *Attorney, Agent, or Firm* — Michael M. Dae; David Cate; Robin Nava

(57) ABSTRACT

A method of lifting a coiled tubing reel is provided that includes providing a coiled tubing reel including a pair of flanges connected by a core around which a string of coiled tubing is wrapped, and a pair of hubs with each hub connected to a corresponding one of the flanges by a plurality of spokes. The method also includes providing a spreader beam including a pair of support members, and connecting each support member to a corresponding one of the reel hubs. The method further includes lifting the coiled tubing reel by applying a lift force to the spreader beam, such that the load of the lift force is carried by the spreader beam, the reel hubs and at least one of the plurality of spokes.

20 Claims, 5 Drawing Sheets

COILED TUBING EQUIPMENT LIFTING METHODS

This non-provisional patent application claims priority to provisional application Ser. No. 60/781,027 filed Mar. 10, 2006.

FIELD OF THE INVENTION

The present invention relates generally to a method of lifting coiled tubing equipment, and more particularly to such a method that significantly reduces the costs of complying with DNV (Det Norske Veritas) lifting standards.

BACKGROUND

When an offshore coiled tubing operation is performed, often the coiled tubing equipment, such as the coiled tubing reel and the coiled tubing power stand, must be lifted off of a boat and transported to an area where an operation may be performed, such as an offshore platform. In many areas, each piece of equipment that is lifted is required to meet DNV lifting standards. Some DNV standards that cover lifting requirements for coiled tubing equipment are DNV 2.7-1, DNV 2.7-3, and RCLA (Rules for Certification of Lifting Appliances.) Each of these lifting standards, as worded on date of the filing of this application, is herein incorporated by reference.

DNV 2.7-1 and 2.7-3 provide requirements for the lifting of coiled tubing equipment that weighs up to 50,000 pounds. DNV 2.7-1 provides requirements for the lifting of "containers." DNV 2.7-3 is a new standard enacted in April of 2006 that provides requirements for the lifting of "portable offshore Units that are not shaped like containers." Above the 50,000 pound limit for DNV 2.7-1 and DNV 2.7-3, RCLA governs.

Each of the three standards require that all of the load carrying members and welds of the lifted equipment meet certain Charpy impact properties and pass a very high level of welding inspection. This inspection includes certifying the welding processes, the machines, the welders that perform the procedures, the Charpy impact properties of the as-deposited weld metal, and the joint fit-up. Also required is a visual inspection of all the welds, a non-destructive evaluation of the welds, load testing to certain (very high) prescribed levels, and a post lifting non-destructive evaluation of the welds. All of this combines to make any equipment certified to these standards extremely expensive relative to equipment built to standard engineering practices.

An additional complication is introduced by the ability to separate the coiled tubing reel from its accompanying power stand, the power stand being a stand that supports the reel and rotates it to make the coiled tubing thereon spool onto or off of the reel depending on the direction of rotation of the reel. Since the coiled tubing reel is one of the heaviest pieces of coiled tubing equipment, it is attractive to lift the reel and the power stand separately from each other. This reduces the weights of the individual lifts and allows for a heavier coiled tubing reel to be lifted onto the rig, if desired. However, this means that the load carrying components of the lifted equipment must be certified to multiple lifting standards in order to account for the wide range of weights that the equipment will weigh when lifted together as opposed to individually.

Typical DNV 2.7-1 skids, such as the skid shown in FIGS. 1A-1B, have an outer crash frame 100 surrounding a coiled tubing reel 105 and a power stand 106. As shown in FIG. 1B, the outer crash frame 100 is also the load carrying structure when the frame 100 is lifted. That is, the crash frame 100 is lifted by attaching cables 102 to four eyelets 104 at the corners of the frame 100, and applying a lift force $F_L$ to the cables 102. As such, the entire crash frame 100 is load carrying, and therefore, each of its components must meet the applicable DNV standards.

For example, the entire frame 100 must be composed of members not less than 0.25" thick (the minimum thickness to Charpy test) and it must have a very large span to go around the items to be enclosed (such as the coiled tubing reel 105 and the power stand 106.) Further, this crash frame 100 often gets in the way of actually using the contents (the reel 105 and stand 106) of the skid. This means that the frame 100 must have removable components to allow access to the reel 105, adding a large number of joints that must be vastly overdesigned to meet the certification requirements of the appropriate DNV standard.

Accordingly, a need exists for a method of lifting coiled tubing equipment that reduces the costs of complying with DNV lifting standards, such as DNV 2.7-1, DNV 2.7-3 and/or RCLA.

SUMMARY

In one embodiment, the present invention is a method of lifting a coiled tubing reel that includes providing a coiled tubing reel including a pair of flanges connected by a core around which a string of coiled tubing is wrapped, and a pair of hubs with each hub connected to a corresponding one of the flanges by a plurality of spokes. The method also includes providing a spreader beam including a pair of support members, and connecting each support member to a corresponding one of the reel hubs. The method further includes lifting the coiled tubing reel by applying a lift force to the spreader beam, such that the load of the lift force is carried by the spreader beam, the reel hubs and at least one of the plurality of spokes.

BRIEF DESCRIPTION OF THE DRAWINGS

These and other features and advantages of the present invention will be better understood by reference to the following detailed description when considered in conjunction with the accompanying drawings wherein.

DETAILED DESCRIPTION OF EMBODIMENTS OF THE INVENTION

As shown in FIGS. 2A-4, embodiments of the present invention are directed to a method of lifting coiled tubing equipment, such as a coiled tubing reel and/or a coiled tubing reel power stand, that minimizes the amount of structures that must be lift certified by DNV (Det Norske Veritas) standards, such as DNV 2.7-1, DNV 2.7-3 and/or the Rules for Certification of Lifting Appliances (RCLA). Embodiments of the invention may also include structures that are covered by any combination or all of DNV 2.7-1, DNV 2.7-3 and RCLA.

In various embodiments, the present invention contemplates various lifting scenarios, such as lifting a coiled tubing reel individually, lifting a coiled tubing reel power stand individually, and lifting a coiled tubing reel together with a coiled tubing reel power stand. A typical coiled tubing reel weighs over 50,000 pounds. As such, lifts involving the coiled tubing reel, either individually or in combination with a coiled tubing power stand, typically must meet the requirements of RCLA. Coiled tubing power stands, on the other hand, typically weigh less than 50,000 pounds. As such, lifts involving only a power stand must meet the requirements of DNV 2.7-1. In the event that the coiled tubing reel weighs less than 50,000 pounds, such a lift must meet the requirements of DNV 2.7-3.

Figure 2A:
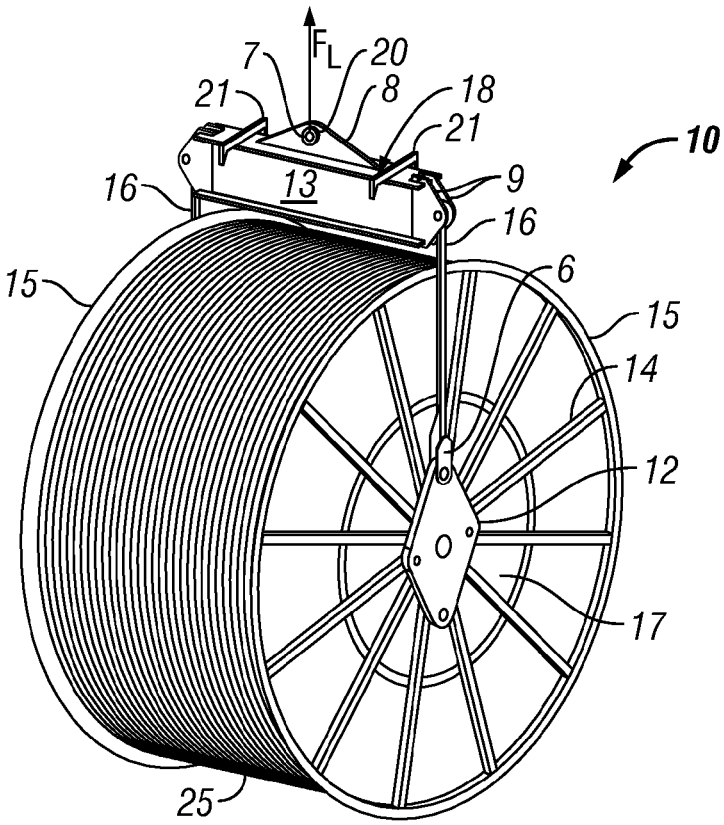
FIG. 2A is a perspective view illustrating a lifting of a coiled tubing reel according to one embodiment of the present invention.
Figure 2B:
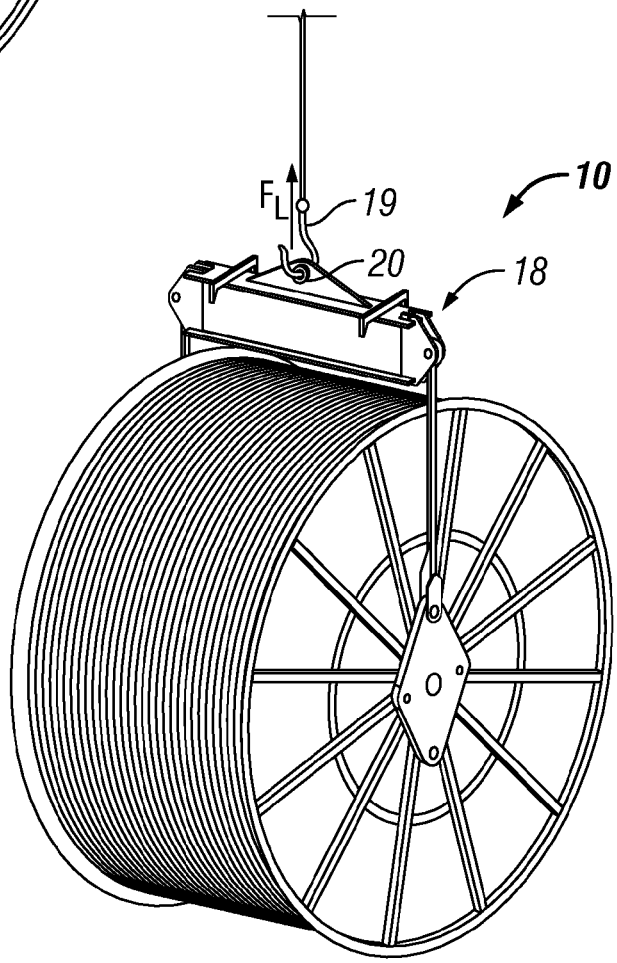
FIGS. 2B-2C show alternative locations for the application of a lifting force on a coiled tubing reel.
Figure 2C:
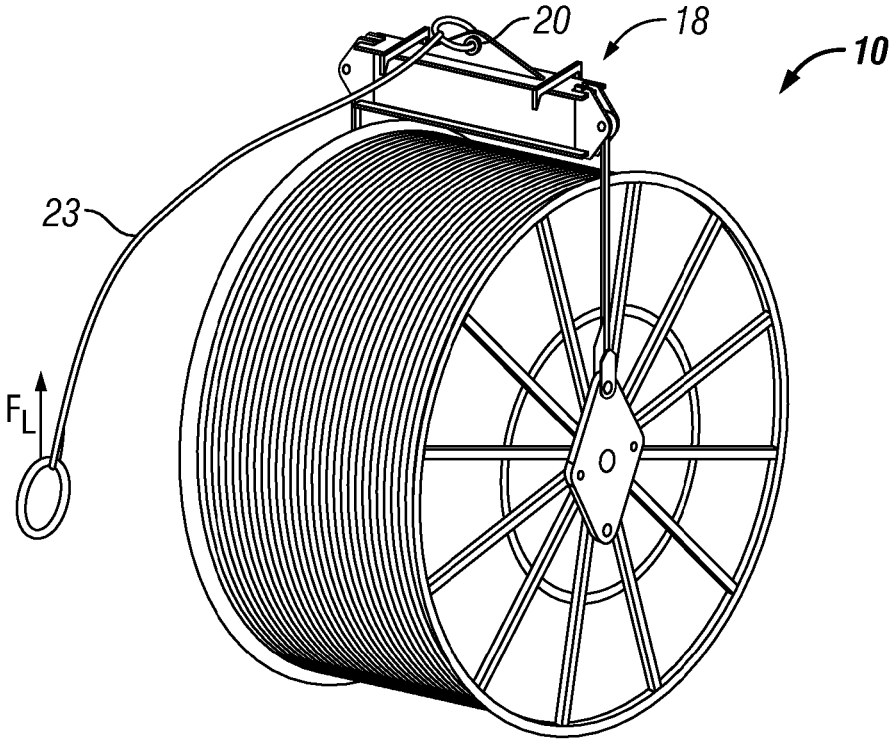

FIG. 2A illustrates a method and apparatus for lifting a coiled tubing reel 10 individually. As shown, the coiled tubing reel 10 is a cylindrical device having a pair of flanges 15 joined by a core 17 around which a string of coiled tubing 25 is wrapped. On each side of the reel 10 is a hub 12 that is connected to a corresponding one of the flanges by a plurality of spokes 14. The hubs 12 are driven by a power stand (discussed below) to rotate the reel 10. Rotating the reel 10 allows the coiled tubing 25 to be spooled onto or off of the core 17 of the reel 10.

In one embodiment, a spreader beam 18 is removably attached to the reel 10. As shown, the spreader beam 18 extends across the core 17 of the reel 10 and is attached to each hub 12 by a vertical support member 16. Each vertical support member 16 includes a pair of spaced apart lugs 6, which receive and pivotally attach to a corresponding one of the hubs 12, such as by a pin.

In one embodiment, the spreader beam 18 includes an I-beam 13, such as a standard steel I-beam. Attached to each end of the I-beam 13 is a pair of spaced apart triangle plates 9, which receive and pivotally attach to a corresponding one of the vertical support members 16, such as by a pin. The pivotal connection of the vertical support members 16 to the spreader beam 18 facilitates attachment of the support members 16 to the reel hubs 12 and allows the support members 16 to be attached to coiled tubing reels of different widths.

A lift force plate 8 is attached to an upper portion of the I-beam 13 and includes a reinforcing ring 7 protruding slightly from the lift force plate and including an opening 20 for receiving a lift force $F_L$. In one embodiment, a method for lifting the reel 10 individually utilizes an integrally formed single spreader beam 18 that allows for multiple possible hook up points for a lift force. A first hook up point is on the spreader beam 18, such as by connecting a main shackle 19 (see FIG. 2B) to the opening 20 in the spreader beam 18, allowing a lift force $F_L$ to be applied directly to the spreader beam 18.

Alternatively, a sling 23 (i.e., a flexible cable, such as that shown in FIG. 2C) may be attached to the opening 20 in the spreader beam 18. The sling 23 includes a hook up point that can be brought down to human height, rather than the height of the opening 20 in the spreader beam 18. The lift force $F_L$ can then be applied to the hook up point on the sling 23. The sling 23 allows for very low clearance lifts if needed, while still allowing the load of the reel 10 to be lifted off of a structure, such as a boat. However, flexible materials such as slings must be DNV certified on a yearly basis. As such, it is desirable to reduce the number of slings used in the lifting process in order to decrease the number of parts that require yearly re-certification.

When the coiled tubing reel 10 is lifted by applying a lift force $F_L$ either directly or indirectly to the spreader beam 18, the load is carried by the following load carrying members: the spreader beam 18, the vertical support members 16, the reel spokes 14, and the reel hub 12. As such, in one embodiment each of the load carrying members for the above described coiled tubing reel lift is designed to meet the certification requirements of DNV 2.7-3 and/or RCLA. In particular, each of these load carrying members:

1.) is at least ¼ inches thick;
2.) is made of a material that can pass a charpy impact test by absorbing a predetermined impact energy at a predetermined material temperature; and
3.) includes a minimum safety factor.

Note that the above "predetermined impact energy," "predetermined material temperature" and "minimum safety factor" are determined by the applicable DNV standard. Also note that even within the same DNV standard, the requirements for certification vary depending on the weight of the object being lifted. For example, the lifting of a 55,000 pound coiled tubing reel and the lifting of a 60,000 pound coiled tubing reel both fall under RCLA. However, the requirements for certification of lifting a 60,000 pound coiled tubing reel are different than the certification requirements for lifting a 55,000 pound coiled tubing reel. As such the above "predetermined impact energy," "predetermined material temperature" and "minimum safety factor" vary depending on the weight of the coiled tubing reel being lifted.

In addition, in one embodiment any welds on any of the load carrying members for the above described coiled tubing reel lift is designed to meet the certification requirements of DNV 2.7-3 and/or RCLA. For example, in one embodiment each of the plates 8,9 is welded to the I-beam 13 of the spreader beam 18, the reinforcing ring 7 is welded to the lift force plate 8, and the support lugs 6 are welded to the vertical support members 16. Each of these welds is produced in a manner that meets a minimum safety factor, which varies depending on the weight of the coiled tubing reel being lifted.

Embodiments of the present invention reduce the number of welds that must be certified and simplifies the design of the load carrying members of the reel 10. In one embodiment, the spreader beam 18 also includes one or more hooks 21, so that when the spreader beam 18 is removed from the coiled tubing reel 10, it can be easily stored, for example by hooking the beam 18 onto an edge of a power stand (discussed below.)

Figure 3:
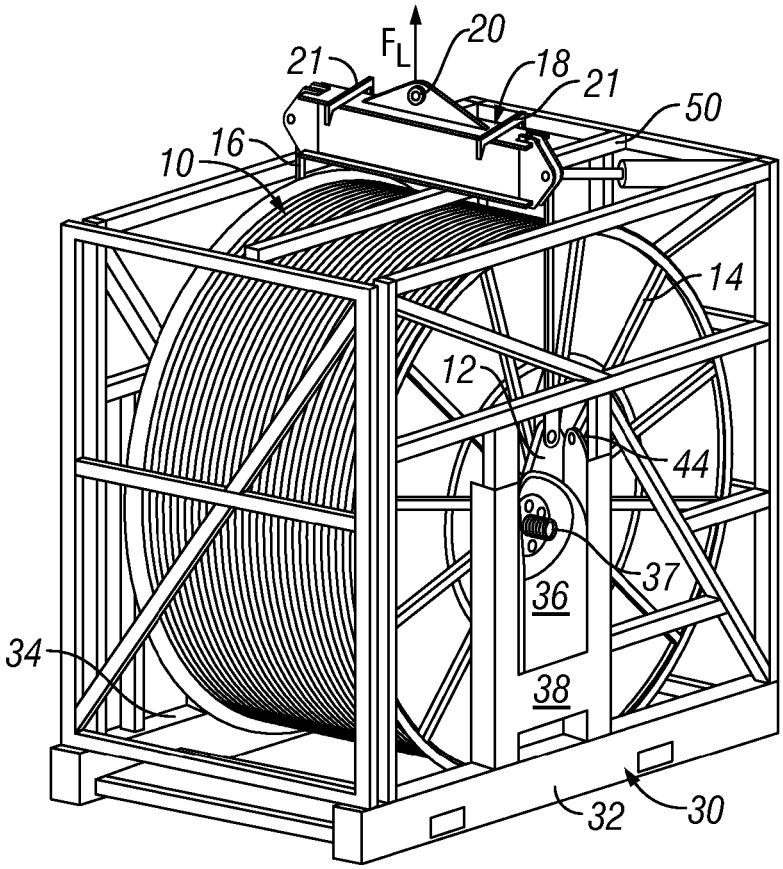
FIG. 3 is a perspective view illustrating a lifting of a coiled tubing reel together with a coiled tubing reel power stand according to another embodiment of the present invention.

FIG. 3 shows a method and apparatus for lifting a combination of the coiled tubing reel 10 and a coiled tubing reel power stand 30. In general, a power stand is a an apparatus that is attached to a coiled tubing reel to perform one or more of the following functions: provide support for the reel, provide rotational motion to the reel, provide a fluid connection to the coiled tubing disposed on the reel, provide a means for neatly wrapping coiled tubing onto the reel, and provide impact resistance.

The combined weight of the coiled tubing reel 10 and the power stand 30 typically exceeds 50,000 pounds. In such a case, the combination lift must meet the requirements of RCLA. If by change, their combined weight is under 50,000 pounds then the combination lift would need to be certified under DNV 2.7-1.

Figure 4:
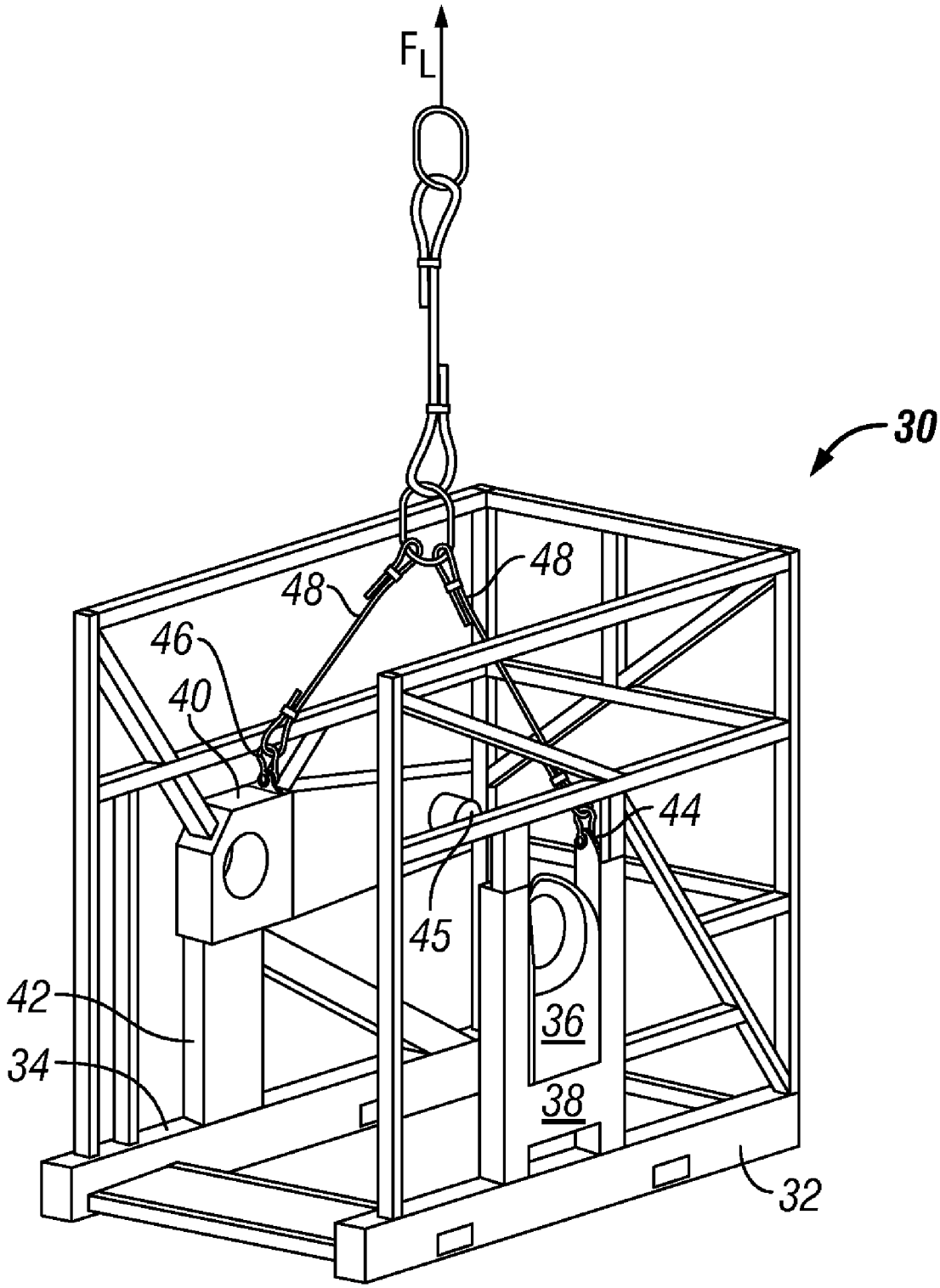
FIG. 4 is a perspective view illustrating a lifting of a coiled tubing reel power stand according to yet another embodiment of the present invention.

Note that although FIG. 4 shows a method and an apparatus for lifting a power stand 30 individual, some structures of the power stand 30 are more clearly shown in FIG. 4, than in FIG. 3. As such, viewing FIGS. 3 and 4 together, the power stand 30 is a generally rectangular structure having a base that includes a front beam 32 and a back beam 34. A swivel arm 36 is connected to the front beam 32 by a swivel arm mount 38. In one embodiment, the swivel arm 36 is connected to a corresponding one of the reel hubs 12 by a plurality of screw fasteners, or by any other appropriate connection. The swivel arm 36 includes an attachment 37 for providing a fluid connection to the coiled tubing 25 disposed on the reel 10. Similarly, a drive hub 40 is connected to the back beam 34 by a drive hub mounting arm 42; and the drive hub 40 is connected to the reel hub 12 by a plurality of screw fasteners, or by any other appropriate connection. The drive hub 40 is connected to a motor 45 which supplies a rotational force to rotate the reel 10.

To lift the combination of the coiled tubing reel 10 and the coiled tubing power stand 30, a lift force $F_L$ may be applied in the same manner as described above for the individual lifting of the reel 10, such as by applying the lift force $F_L$ directly to the spreader beam 18 by use of a shackle 19 or indirectly by use of a sling 23. When the reel 10 and power stand 30 are lifted together, the load is carried by the following load carrying members: the spreader beam 18, the vertical support members 16, the reel spokes 14, and the reel hub 12, the swivel arm 36, the swivel arm mount 38, the front beam 32 on the base of the power stand 30, the drive hub 40, the drive hub mounting arm 42, and the back beam 34 on the base of the power stand 30.

As such, in one embodiment each of the load carrying members for the above described coiled tubing reel and power stand lift is designed to meet the certification requirements of DNV 2.7-1 and/or RCLA. Specifically, each of these load carrying members is designed to meet certain charpy impact test requirements and meet a minimum safety factor, each of which varies depending on the combined weight of the reel and power stand being lifted.

In addition, in one embodiment any welds on any of the load carrying members for the above described coiled tubing reel and power stand lift is designed to meet the certification requirements of DNV 2.7-1 and/or RCLA. For example, in one embodiment the swivel arm mount 38 is composed of three rectangular metal tubes arranged in an H shape and welded to each other at the ends of the middle box forming the H shape, and to the front beam 32 along the bottom ends of the vertical legs of the H shape; the drive hub mounting arm 42 is composed of a rectangular metal tube welded at one end to the back beam 42 and at another end to the drive hub 40; and lifting lugs 44, 46 are welded to the swivel arm 36 and the drive hub 40, respectively. Each of these welds is produced in a manner that meets a minimum safety factor, which varies depending on the combined weight of reel and power stand being lifted.

Elements of the power stand 30 shown in FIGS. 3 and 4 that are not specifically mentioned above function as a crash frame for impact resistance. Since these elements do not function to carry a load during the above described lift of the reel 10 and power stand 30, they do not have to meet the DNV requirements. As such, this crash frame may be manufactured much more inexpensively than the crash frame 100 of the prior art which must meet the requirements of RCLA since it does carry a load during the prior art method of lifting a coiled tubing reel and power stand. As a result, in one embodiment the elements of power stand 30 which function as a crash frame are designed following standard engineering practices, rather than the more rigorous RCLA and DNV standards.

FIG. 4 shows a method and apparatus for lifting a coiled tubing power stand 30 individually. Since power stands typically weigh less than 50,000 pounds, power stand lifts typically must meet the requirements of DNV 2.7-1. However, in the event that the power stand exceeds 50,000 pounds in weight, the lift of such a stand must meet the requirements of RCLA. For the individual lift of the power stand 30, the power stand 30 includes a lifting lug 44 on the swivel arm mount 38, and a lifting lug 46 on the drive hub 40. Cables 48 may be attached to the lifting lugs 44, 46 to allow a lift force $F_L$ to be applied to the power stand 30. In one embodiment, each lifting lug 44, 46 includes a reinforcing ring welded thereto similar to the reinforcing ring 7 on the lift force plate 8 of the spreader beam 18 described above and shown in FIG. 2A.

When the power stand 30 is lifted, the load is carried by the following load carrying members: the lifting lugs 44 and 46, the swivel arm mount 38, the front beam 32 on the base of the power stand 30, the drive hub 40, the drive hub mounting arm 42, and the back beam 34 on the base of the power stand 30. As such, in one embodiment each of the load carrying members for the above described power stand lift is designed to meet the certification requirements of DNV 2.7-1 and/or RCLA. Specifically, each of these load carrying members is designed to meet certain charpy impact test requirements and meet a minimum safety factor, each of which varies depending on the weight of the power stand lifted In addition, in one embodiment any welds on any of the load carrying members for the above described power stand lift is designed to meet the certification requirements of DNV 2.7-1 and/or RCLA. Each of these welds is produced in a manner that meets a minimum safety factor, which varies depending on the weight of the power stand being lifted.

In one embodiment, the power stand 30 is designed to allow for a lifting of the power stand 30 individually or together with the reel 10. As such, in this embodiment each of the load carrying member for the power stand 30 (which are the same regardless of whether the lift is in combination with or separate from the reel) are designed to meet the requirements of both DNV 2.7-1 and RCLA.

Lifts certified by DNV 2.7-1 requires a crash frame. However, as long as the crash frame is not load carrying (which according to the method of FIG. 4, it is not) it can be constructed according to standard engineering practices, and does not need to meet the more rigorous design requirements of DNV 2.7-1. As a result, in one embodiment the elements of the power stand 30 which function as a crash frame are designed following standard engineering practices, rather than the more rigorous RCLA and DNV standards. Also, repairs to the crash frame may be made without having to meet the requirements of DNV 2.7-1.

Figure 1A:
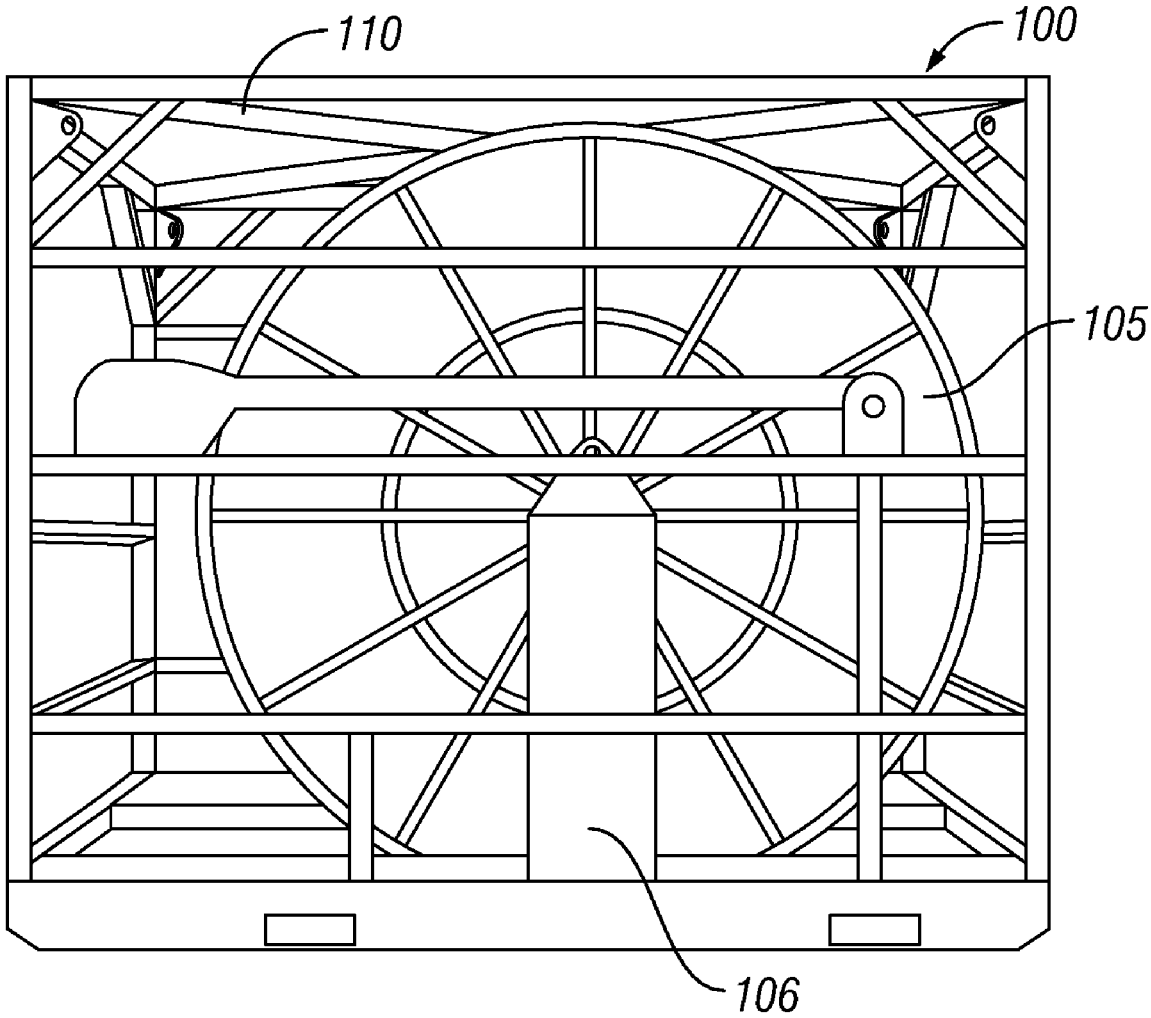
FIG. 1A (Prior Art)
FIG. 1A is a side view of a lifting skid according to a prior art method of lifting a coiled tubing reel.
Figure 1B:
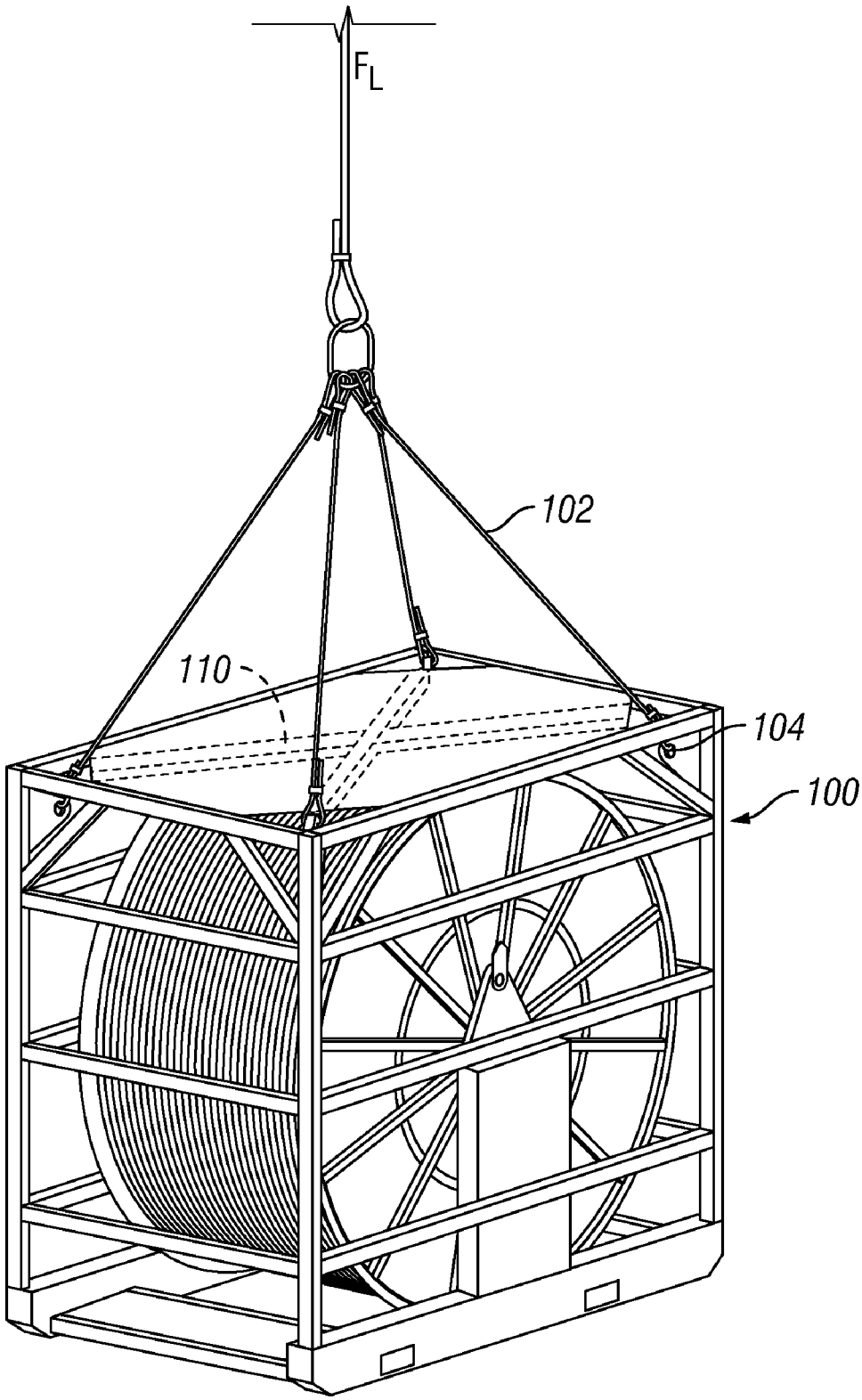
FIG. 1B (Prior Art)
FIG. 1B is a schematic representation of a lifting of the skid of FIG. 1A.

In addition, the prior art method shown in FIGS. 1A-1B requires extensive certification testing on the attachment eyelets 104 and requires a support beam 110 to be attached to the attachment eyelets 104. The lifting methods of the present invention lessen the components required for certification testing and removes the requirement of the attachment eyelets support beam 110. Without the requirement of the attachment eyelets support beam 110, a level wind system 50 (see FIG. 3) may be lifted with the power stand 30 and accessed without having to remove the attachment eyelets support beam 110. The level wind system 50 may be any appropriate system for neatly wrapping the coiled tubing 25 around the reel 10, such as any of those described in U.S. Pat. No. 6,264,128, which is herein incorporated by reference.

In each of the above described lifts, the coiled tubing reel 10 and/or the power stand 30 is moved from a floating vessel, such as a boat, to an offshore platform to allow the coiled tubing 25 disposed on the reel 10 to be deployed into a well in order to perform a well services operation, such as a well clean out, or any other appropriate well services operation.

The preceding description has been presented with reference to presently preferred embodiments of the invention. Persons skilled in the art and technology to which this invention pertains will appreciate that alterations and changes in the described structures and methods of operation can be practiced without meaningfully departing from the principle, and scope of this invention. Accordingly, the foregoing description should not be read as pertaining only to the precise structures described and shown in the accompanying drawings, but rather should be read as consistent with and as support for the following claims, which are to have their fullest and fairest scope.

What is claimed is:

1. A method of lifting a coiled tubing reel comprising:

providing a coiled tubing reel comprising a pair of flanges connected by a core around which a string of coiled tubing is wrapped, and a pair of hubs with each hub connected to a corresponding one of the flanges by a plurality of spokes;

providing a coiled tubing reel power stand comprising a base, a swivel arm for connection to a first of the reel hubs, and a drive hub for connection to a second of the reel hubs, wherein the swivel arm is connected to a front beam of the base, and wherein the drive hub is connected to a back beam of the base;

providing a spreader beam comprising a pair of support members pivotally connected thereto;

wherein said spreader beam is configured to perform both a first mode of operation and a second mode of operation;

wherein said first mode of operation comprising:

pivotally connecting each support member to a corresponding one of the reel hubs; and lifting the coiled tubing reel by applying a lift force to the spreader beam, such that the load of the lift force is carried by the spreader beam, the reel hubs and at least one of the plurality of spokes: and wherein said second mode of operation comprising:

attaching the power stand to the coiled tubing reel; and lifting the coiled tubing reel and the power stand by applying a lift force to the spreader beam, such that the load of the lift force is carried by the spreader beam, the reel hubs, at least one of the plurality of spokes; the swivel arm, the front beam of the base, the drive hub, and the back beam of the base.

2. The method of claim 1, wherein the spreader beam, the reel hubs and at least one of the plurality of spokes each have a predetermined thickness, is formed from a material that absorbs a predetermined impact energy at a predetermined material temperature and complies with a minimum design safety factor.

3. The method of claim 1, wherein the spreader beam, the reel hubs and at least one of the plurality of spokes comprise welds that each meet a minimum design safety factor.

4. The method of claim 1, wherein said lifting further comprises moving the coiled tubing reel from a boat to an area where a well services operation may be performed.

5. The method of claim 4, wherein said area is an offshore platform.

6. The method of claim 1, wherein said coiled tubing reel weighs less than 50,000 pounds.

7. The method of claim 1, wherein said coiled tubing reel weighs more than 50,000 pounds.

8. The method of claim 1, wherein the support members are pivotally movable with respect to a main body of the spreader beam and are pivotally attachable to coiled tubing reels of different widths.

9. The method of claim 1, wherein each support member is removably connected to its corresponding reel hub.

10. The method of claim 1, wherein providing a spreader beam comprising a pair of support members pivotally connected thereto comprises providing a spreader beam comprising a pair of rigid support members pivotally connected thereto.

11. A method of lifting a coiled tubing reel and a coiled tubing reel power stand together comprising:

providing a coiled tubing reel comprising a pair of flanges connected by a core around which a string of coiled tubing is wrapped, and a pair of hubs, with each hub connected to a corresponding one of the flanges by a plurality of spokes;

providing a spreader beam comprising a pair of support members;

connecting each support member to a corresponding one of the reel hubs;

providing a coiled tubing reel power stand comprising a base, a swivel arm for connection to a first of the reel hubs, and a drive hub for connection to a second of the reel hubs, wherein the swivel arm is connected to a front beam of the base, and wherein the drive hub is connected to a back beam of the base;

attaching the power stand to the coiled tubing reel; and lifting the coiled tubing reel and the power stand by applying a lift force to the spreader beam, such that the load of the lift force is carried by the spreader beam, the reel hubs, at least one of the plurality of spokes; the swivel arm, the front beam of the base, the drive hub, and the back beam of the base.

12. The method of claim 11, wherein the spreader beam, the reel hubs, at least one of the plurality of spokes; the swivel arm, the front beam of the base, the drive hub, and the back beam of the base each have a predetermined thickness, is formed from a material that absorbs a predetermined impact energy at a predetermined material temperature and complies with a minimum design safety factor.

13. The method of claim 12, further comprising connecting a crash frame to the coiled tubing reel power stand, wherein the crash frame is not subjected to the load of the lift force.

14. The method of claim 11, wherein the spreader beam, the reel hubs, at least one of the plurality of spokes; the swivel arm, the front beam of the base, the drive hub, and the back beam of the base comprise welds that each meet a minimum design safety factor.

15. The method of claim 14, wherein said swivel arm mount and said drive hub mounting arm each have a predetermined thickness, is formed from a material that absorbs a predetermined impact energy at a predetermined material temperature and complies with a minimum design safety factor.

16. The method of claim 11, wherein the swivel arm comprises a swivel arm mount for connecting the swivel arm to the front beam of the base; and wherein the drive hub comprises a mounting arm for connecting the drive hub to the back beam of the base.

17. The method of claim 11, wherein said lifting further comprises moving the coiled tubing reel and the power stand from a boat to an offshore platform.

18. The method of claim 11, wherein each support member is removably connected to its corresponding reel hub.

19. The method of claim 11, wherein the swivel arm includes an attachment for providing a fluid connection to the string of coiled tubing disposed on the reel, and wherein the drive hub is connected to a motor which supplies a rotational force to rotate the reel.

20. A method of performing a well services operation comprising:

providing a coiled tubing reel comprising a pair of flanges connected by a core around which a string of coiled tubing is wrapped, and a pair of hubs, with each hub connected to a corresponding one of the flanges by a plurality of spokes;

providing a spreader beam comprising a pair of support members;

connecting each support member to a corresponding one of the reel hubs;

providing a coiled tubing reel power stand comprising a base, a swivel arm for connection to a first of the reel hubs, and a drive hub for connection to a second of the reel hubs, wherein the swivel arm is connected to a front beam of the base, and wherein the drive hub is connected to a back beam of the base;

attaching the power stand to the coiled tubing reel;

lifting the coiled tubing reel and the power stand by applying a lift force to the spreader beam, such that the load of the lift force is carried by the spreader beam, the reel hubs, at least one of the plurality of spokes; the swivel arm, the front beam of the base, the drive hub, and the back beam of the base;

moving the coiled tubing reel and the power stand from a floating vessel to an area where a well services operation may be performed;

deploying a portion of the string of coiled tubing into a well; and performing a well services operation.

* * * * *